United States Patent [19]

Stacher

[11] 4,403,630

[45] Sep. 13, 1983

[54] APPARATUS FOR TENSIONING THE WARP THREAD SHEET OF A LOOM

[75] Inventor: Miguel A. Stacher, Arbon, Switzerland

[73] Assignee: Aktiengesellschaft Adolf Saurer, Arbon, Switzerland

[21] Appl. No.: 287,632

[22] Filed: Jul. 28, 1981

[30] Foreign Application Priority Data

Aug. 26, 1980 [CH] Switzerland ..... 6417/80

[51] Int. Cl.[3] ..... D03D 49/06; D03D 39/22

[52] U.S. Cl. ..... 139/102; 139/25; 139/97; 66/146

[58] Field of Search ..... 139/25, 27, 102, 97, 139/114, 115; 60/146, 213, 209; 242/75

[56] References Cited

U.S. PATENT DOCUMENTS

| | | | |
|---|---|---|---|
| 2,308,430 | 1/1943 | Bolden et al. | 66/213 |
| 2,637,184 | 5/1953 | Schoenster | 66/146 |
| 2,811,027 | 10/1957 | Held | 66/146 |
| 2,932,325 | 4/1960 | Patrick | 139/102 X |
| 3,871,419 | 3/1975 | Pfarrwaller | 139/25 X |

FOREIGN PATENT DOCUMENTS

| | | | |
|---|---|---|---|
| 2061908 | 6/1972 | Fed. Rep. of Germany | 66/146 |

*Primary Examiner*—James Kee Chi
*Attorney, Agent, or Firm*—Werner W. Kleeman

[57] ABSTRACT

An apparatus for tensioning warp threads of a loom comprises a warp beam from which the warp threads are withdrawn by means of a support beam and a deflection beam. The deflection beam is secured to the support beam by means of bending springs acting in the direction of the deflected warp threads. The bending or deflection length of the bending springs is adjustable for preselected setting of the warp thread tension in that the bending springs are supported at their bending or deflection side by means of a bending-resistant support plate which is adjustable in lengthwise direction. These measures provide for a purely mechanical, simple, easily adjustable and functionally reliable tensioning apparatus which is particularly suitable for the pile warp of a Terry weaving machine.

5 Claims, 2 Drawing Figures

APPARATUS FOR TENSIONING THE WARP THREAD SHEET OF A LOOM

BACKGROUND OF THE INVENTION

The present invention relates to a new and improved apparatus for tensioning the warp thread sheet or set of warp threads of a weaving machine, in particular the warp pile of a Terry weaving machine or loom, containing a deflection beam yielding to the alternating tensions of warp threads which are withdrawn from a warp beam.

It is generally known that particularly with Terry weaving machines the inertia of the moving parts of the apparatus for tensioning the pile warp are of great importance, because of the great number of movements during the nep formation and the moderate forces which have to be applied for producing the slight warp pile tension. In particular, considerable variations of the pile warp tension can be observed. Moreover, during a full stroke of the reed for forming the pile neps the pile warp threads experience a sudden acceleration, which is transmitted to the moving parts of the tensioning apparatus which are under the effect of forces producing the tension of the pile warp. The force for accelerating such moving parts is thus dependent on the inertia masses and has to be supplied by the pile warp which thus undergoes a corresponding increase in tension. Therefore, it may happen that some pile warp threads, which are still loosely bound only by a few weft threads, initially do not follow the reed, whereby some thread length for the nep formation gets lost. Furthermore, the moveable parts of the tensioning apparatus for the pile warp depart from their rest position and swing out when the reed beats the woven cloth. When they return to their rest position under the effect of the force creating the pile warp tension, such movable parts are stopped by the pile warp, which thus experiences another increase in tension. Such increase may, in turn, consume thread length from the neps causing these to become irregular.

In order to reduce the inertia mass of the movable parts at the tensioning apparatus for the pile warp, there has been proposed in German Pat. No. 2,162,396 using a deflection beam for warp thread sheets, wherein a rigid support element, which is mounted at its ends upon the machine carriage and extends over the width of the warp thread sheet, is at least partially surrounded by a thereto attached deflection element which is formed of a substantially blade-like material and elastically yields to the alternating tension of the threads.

For this purpose the blade-like material is formed of a smooth spring band bent in the fashion of a cylinder surface and connected to the support element, so that the deflection element forms a bent supporting surface which yields in the direction of the angle bisecting line and is located between the in-running or inbound and the off-running or outbound warp thread sheet and serves for guiding the warp threads which are to be deflected.

This solution is not only expensive, but in order to avoid vibrations at the deflection element it is also necessary to place damping or cushioning, yielding support bodies between the support element and the yielding deflection element. This arrangement makes it difficult to alter the warp thread tension.

From Swiss Pat. No. 596,362 there is known another arrangement, wherein the deflection beam is formed by a light hollow cylinder which is attached to the machine frame by means of pivotal arms and is supported by a pressure cushion extending substantially in the lengthwise direction of the deflection beam. For indication and adjustment of the warp thread tension the pressure cushion is constructed as a substantially hose-like sleeve which is filled with a medium under selectable pressure. This construction is also expensive, in particular with respect to the choice and the retention of the pressure for creating the warp thread tension. With this tensioning apparatus additional supervision or monitoring devices are needed because of the danger of leaks in the pressure cushion.

SUMMARY OF THE INVENTION

Therefore, it is a primary object of the present invention to provide an improved apparatus for tensioning the warp thread sheet in a manner not associated with the aforementioned drawbacks and shortcomings of the prior art.

In particular, it is a further important object of the invention to provide a warp tensioning apparatus which only has mechanical parts or components and is therefore absolutely reliable and easy to design.

According to the invention these and further objects are obtained in that the deflection beam is connected to the support, e.g. the support beam by means of bending springs acting in the direction of the deflected warp threads.

In order to be able to preselect or initially set the warp or warp thread tension, it is preferably contemplated that the bending length of the bending springs is variable. This can easily be achieved by supporting each of the bending springs on their bending side by a longitudinally displaceable and bending-resistant support plate. The bending springs are preferably plate springs.

With a preferred embodiment of the invention the further construction may comprise a support which is constituted by a support beam pivotably mounted on the machine frame and serving for supporting the warp threads, whereby there is secured against rotation at each end thereof one of the bending springs. With this arrangement it is advantageous if the support beam is exposed to the tension of spring means acting against the rotational action of the warp threads.

Furthermore, it is advantageous to support each of the bending springs by a longitudinally adjustable supporting plate secured to the free end of a bending-resistant pivotal arm which at its other end is rigidly mounted for rotation at the support beam.

BRIEF DESCRIPTION OF THE DRAWINGS

The invention will be better understood and objects other than those set forth above will become apparent when consideration is given to the following detailed description thereof. Such description makes reference to the annexed drawings which depict an exemplary embodiment of the invention described hereinafter and wherein.

DETAILED DESCRIPTION OF THE PREFERRED EMBODIMENTS

Figure 2:
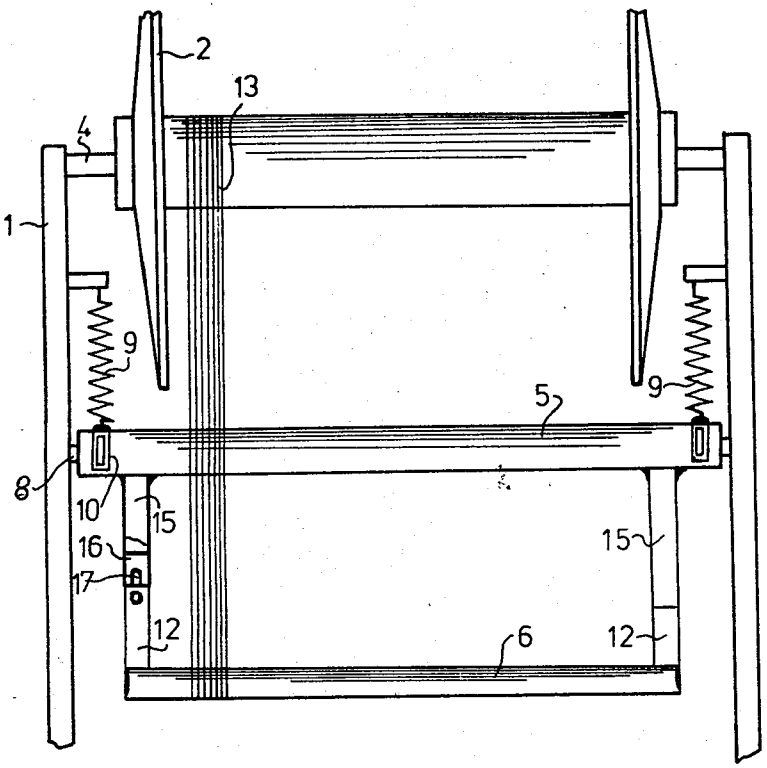
FIG. 2 is a front view of the apparatus according to FIG. 1.
Figure 1:
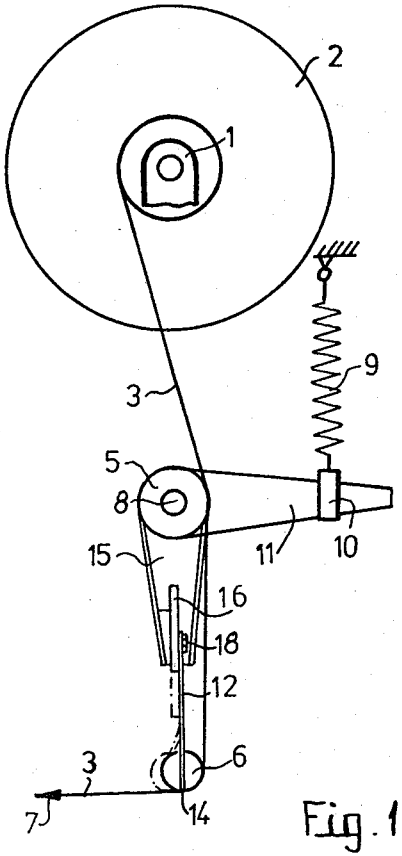
FIG. 1 is a side schematic view of an apparatus for tensioning the warp thread sheet according to the invention.

Describing now the drawings, a so-called warp beam 2 which here carries the threads 3 of a pile warp of a Terry weaving machine is rotatably mounted by means of a shaft 4 at the frame 1 of a here not further illustrated weaving machine. The warp threads 3 are withdrawn from the warp beam 2 via a support here shown as a support beam 5, and a deflection beam 6 in the direction 7 of a here not further illustrated weaving harness or the like.

The support beam 5 serving for supporting the warp threads 3 is rotatably mounted at the machine frame 1 by means of its shaft or axle 8 and extends essentially past the length of the warp beam 2, as shown in FIG. 2. The support beam 5 is exposed, in a known manner, to the rotational action of the warp threads 3, whereby such rotational action is counteracted by means of tension springs 9 having a flat spring characteristic. Such tension springs 9 are located at each end of the support beam 5 and engage with one end thereof at the machine frame 1. With their other end such tension springs 9 are attached to the free end of a pivotal or pivot arm 11 by means of a collar 10 or equivalent structure. Such pivotal arms 11 are mounted against rotation at the support beam 5 and radially protrude therefrom.

According to the invention, the deflection beam 6 is fixed to the support beam 5 by means of substantially blade-shaped bending springs 12 acting in the direction 7 of the deflected warp threads 3, whereby on both sides the fixing or attachment points are of course outside the pile warp 13 which in FIG. 2 is indicated by a few threads.

The arrangement of the invention is constructed, for instance, such that the blade springs 12 engage with one end thereof into slots 14 of the deflection beam 6, where they are, for instance, pinned or otherwise suitably fixed. The other end of each blade spring 12 is bolted with the free end of a bending-resistant pivotal or pivot arm 15, which pivotal arms 15 are also rigidly mounted for rotation at the support beam 5.

Now, in order to be able to preset the tension of the warp threads 3 by altering the bending length of the blade springs 12, each bending spring 12 is, for instance, supported on its bending side by a bending-resistant support or carrier plate 16 which is longitudinally adjustable. For this purpose, each support plate 16 is provided with an elongated hole 17, through which the fastening bolt or screw 18 for the related bending spring 12 is screwed or bolted to the pivotal arm 15.

With the foregoing in mind it becomes obvious that by the measures described herein there is achieved a purely mechanical, easy to manufacture and absolutely reliable tensioning apparatus, whereby the provided measures allow virtually all existing machines of the aforementioned type to be retrofitted in the fashion described above. Also, many modifications of the described exemplary embodiment are possible without departing from the spirit and underlying principles of this invention.

While there are shown and described preferred embodiments of the invention, it is to be dinstictly understood that the invention is not limited thereto but may be embodied and practised within the scope of the following claims. Accordingly,

What I claim is:

1. An apparatus for tensioning a warp thread sheet of a weaving machine, particularly the pile warp of a Terry weaving machine, comprising:

a deflection beam which yields under the action of the alternating tension of warp threads withdrawn from a warp beam;

a support beam serving for supporting the warp threads;

said support beam having opposed ends;

bending springs effective in a direction of deflection of the warp threads travelling over said deflection beam;

said deflection beam being supported at both opposed ends of said support beam by means of said bending springs;

means mounting each of said bending springs rigidly for rotation with said support beam;

spring means provided for said support beam;

said support beam being subjected to the tension of said spring means which counteract a rotational action of the warp threads exerted upon said support beam;

said mounting means including a respective bending-resistant adjustable support plate which is adjustable in longitudinal direction thereof provided for each of the bending springs; and said bending springs being supported upon each related one of said bending-resistant adjustable support plates in order to be able to change the effective bending length of said bending springs.

2. The apparatus as defined in claim 1, wherein: said bending springs comprise blade springs.

3. The apparatus as defined in claim 1, further including:

a bending-resistant pivotal arm provided for each bending spring;

each of said bending springs being supported by a related one of said adjustable support plates at a free end of a related one of said bending-resistant pivotal arms, and each said pivotal arm being mounted at its other end rigidly for rotation at said support beam.

4. The apparatus as defined in claim 1, wherein:

said mounting means further include a respective pivotal arm carrying a related one of said adjustable support plates and rigidly mounted for rotation at the support beam.

5. The apparatus as defined in claim 3, wherein:

the bending springs comprise blade springs.

* * * * *